US006313801B1

(12) United States Patent
Sanford et al.

(10) Patent No.: US 6,313,801 B1
(45) Date of Patent: Nov. 6, 2001

(54) ANTENNA STRUCTURES INCLUDING ORTHOGONALLY ORIENTED ANTENNAS AND RELATED COMMUNICATIONS DEVICES

(75) Inventors: Gary George Sanford, Apex; Huan-Sheng Hwang, Cary, both of NC (US)

(73) Assignee: Telefonaktiebolaget LM Ericsson, Stockholm (SE)

( * ) Notice: Subject to any disclaimer, the term of this patent is extended or adjusted under 35 U.S.C. 154(b) by 0 days.

(21) Appl. No.: 09/648,495

(22) Filed: Aug. 25, 2000

(51) Int. Cl.[7] ..... H01Q 1/38; H01Q 21/00

(52) U.S. Cl. ..... 343/725; 343/700 MS; 343/702; 343/729

(58) Field of Search ..... 343/700 MS, 725, 343/729, 702

(56) References Cited

U.S. PATENT DOCUMENTS 5,300,936 * 4/1994 Izadian ..... 343/700 MS 6,160,512 * 12/2000 Desclos et al. ..... 343/700 MS

* cited by examiner

*Primary Examiner*—Don Wong
*Assistant Examiner*—Hoang Nguyen
(74) *Attorney, Agent, or Firm*—Myers Bigel Sibley & Sajovec

(57) ABSTRACT

In an antenna structure including multiple antennas, a first antenna can include a conductive patch and a second antenna can be adjacent the conductive patch. More particularly, the second antenna can define a central axis wherein the central axis is orthogonal with respect to the first antenna and wherein the central axis intersects a central portion of the conductive patch. Alternately or in addition, a first antenna can include a conductive patch with an opening through the conductive patch, and a second antenna can be adjacent the conductive patch wherein a feedline for the second antenna extends through the opening through the conductive patch.

38 Claims, 5 Drawing Sheets

ANTENNA STRUCTURES INCLUDING ORTHOGONALLY ORIENTED ANTENNAS AND RELATED COMMUNICATIONS DEVICES

BACKGROUND OF THE INVENTION

The present invention relates to the field of antenna structures and more particularly to antenna structures and devices including at least two antennas.

Radiotelephone mobile terminals are being developed including multiple functionalities. For example, mobile terminals are being developed that will provide both radiotelephone communications as well as global positioning system (GPS) functions. When making an emergency (911) call, the mobile terminal could thus precisely determine its location, and transmit that location as a part of the emergency (911) call.

The addition of a GPS antenna and receiver to a mobile terminal may result in complications. First, the volume of a GPS antenna may be difficult to incorporate in a relatively small mobile terminal. In other words, it may be difficult to add a GPS antenna without increasing a size of the mobile terminal. Moreover, simply adding another antenna to the outside of the mobile terminal may be esthetically undesirable.

A second potential complication relates to isolation of the GPS antenna and the communications antenna. In a small mobile terminal, the GPS antenna and the communications antenna may need to coexist in close proximity. The resulting interference and/or coupling between the two antennas may degrade the performance of both global positioning and communications functionality. For example, a circuit coupled to one antenna may absorb power coupled to it from the other antenna thereby reducing efficiency of the other antenna. Alternately, a circuit coupled to one antenna may reflect power coupled from the other antenna thereby distorting a radiation pattern for the other antenna.

Isolation of 10 dB to 15 dB or higher may thus be desirable to acceptably reduce coupling and/or interference between the two antennas and to maintain both GPS and communications functionalities. While filters may be used to provide isolation between the antennas, filters may undesirably increase costs in terms of circuit board area, insertion loss, and component cost.

SUMMARY OF THE INVENTION

In embodiments of the present invention, antenna structures and radio devices including multiple antennas are provided. According to first embodiments, an antenna structure can comprise a first antenna including a conductive patch and a second antenna adjacent the conductive patch. More particularly, the second antenna can define a central axis wherein the central axis is orthogonal with respect to the first antenna and wherein the central axis intersects a central portion of the conductive patch. According to alternate embodiments, an antenna structure can comprise a first antenna including a conductive patch with an opening through the conductive patch, and a second antenna adjacent the conductive patch wherein a feedline for the second antenna extends through the opening through the conductive patch. Embodiments according to the present invention can thus be used alone or in combination to provide compact antenna structures with multiple antennas.

DETAILED DESCRIPTION

Figure 1A:
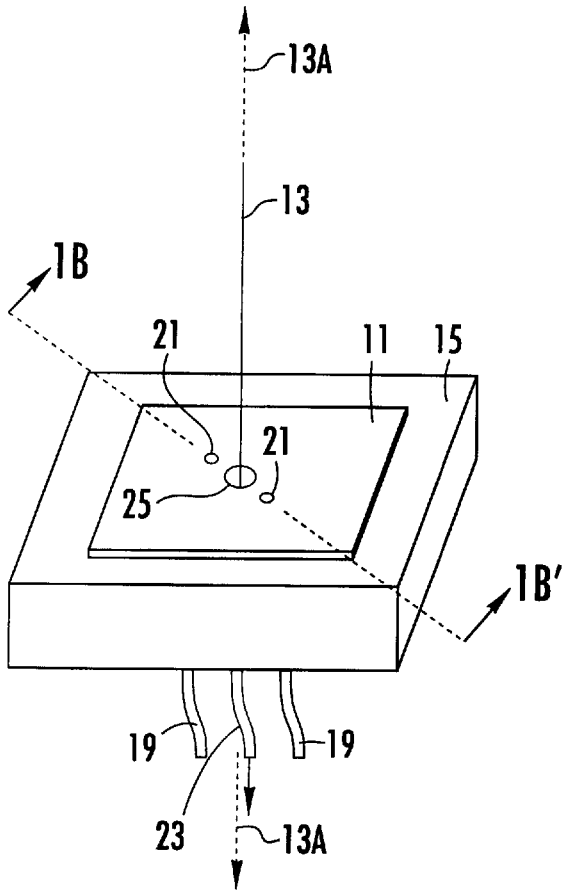
FIG. 1A is a perspective view of antenna structures according to embodiments of the present invention.

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. In the drawings, the thickness of layers and regions are exaggerated for clarity. It will also be understood that when an element such as a layer, region or substrate is referred to as being "on" another element, it can be directly on the other element or intervening elements may also be present.

Figure 1B:
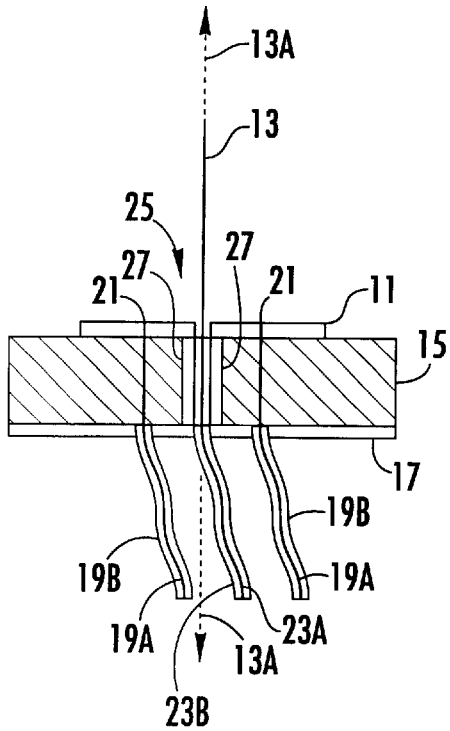
FIG. 1B is a cross sectional view taken along section line 1B–1B' of FIG. 1A.

Examples of antenna structures according to the present invention are illustrated in the plan and cross sectional views of FIGS. 1A and 1B. As shown, an antenna structure according to the present invention can include a first patch antenna comprising a conductive patch 11 and a second monopole antenna comprising a monopole 13. The conductive patch 11 can be provided on a dielectric layer 15, a conductive ground plane 17 can be provided on the dielectric layer 15 opposite the conductive patch 11, and one or more coaxial feedlines 19 can be arranged with respect to the conductive patch 11 to provide circular polarization for the first antenna. In addition, the conductive patch 11 can be planar.

The monopole 13 can define a central axis 13A that is orthogonal and centered with respect to a plane of the conductive patch 11 so that the monopole 13 is perpendicular and centered with respect to the conductive patch 11. Moreover, the monopole 13 can be symmetric with respect to the central axis 13A. Fields of the monopole 13 coupling with the ground plane 17 can thus be symmetric with respect to the center of the conductive patch 11 of the circularly polarized patch antenna so that interference of the second antenna comprising the monopole 13 cancel with respect to the first patch antenna comprising the conductive patch 11 and vice versa. Coupling of the two antennas can thus be reduced through the arrangement of antennas illustrated in FIGS. 1A–B.

The first patch antenna comprising the conductive patch 11 can thus be used to provide a relatively small GPS patch antenna for a GPS receiver, and the second monopole antenna comprising the monopole 13 can be used to provide a radiotelephone antenna for a radiotelephone transceiver. Generally, coupling between a patch antenna and a monopole antenna will increase as a distance between the two is reduced. By positioning a monopole antenna that is symmetrical with respect to its central axis over the center of a balanced patch antenna and orthogonal with respect to the patch antenna (as shown in FIGS. 1A–B), a theoretically infinite isolation can be provided between the two antennas. In practice, isolation between two such antennas can exceed 20 dB.

As shown in the cross section of FIG. 1B, the monopole 13 can be coupled with a coaxial feedline 23 to provide coupling between the monopole 13 and a radio transmitter and/or receiver. More particularly, the coaxial feedline 23 can include a central feedline 23A and an outer groundline 23B wherein the central feedline 23A is coupled with the monopole 13 through a hole 25 in the dielectric layer 15 and the outer groundline 23B is coupled with both the conductive ground plane 17 and the conductive patch 11 through the hole 25 in the dielectric layer 15. Coupling through the hole 25 between the conductive ground plane 17 and the conductive patch 11 can be provided through conductive plating 27 of the hole 25. Alternately, coupling between the ground plane 17 can be provided by extending a portion of the outer groundline 23B (or other conductor) through the hole 25. Coupling between the monopole 13 and the inner conductor and the central feedline 23A can be provided by extending a portion of the central feedline 23A through the hole 25, extending a portion of the monopole 13 through the hole 25, and/or extending another conductive material through the hole 25.

The central portion of the conductive patch 11 can thus be electrically shorted to the conductive ground plane 17. The performance of the patch antenna comprising the conductive patch 11 is not significantly affected, however, because the center of the patch is a voltage null point. Because the diameter of the hole 25 is greater than zero, however, small adjustments in the feed ports 21 and in the dimensions of the conductive patch 11 may be needed. Similarly, the coaxial feedlines 19 can include respective inner conductors 19A coupled with the feed ports 21 and outer groundlines 19B coupled with the conductive ground plane 17. Coupling of the feed ports and outer groundlines 19B can also be provided using a portion of the inner conductors 19A, a plated hole through the dielectric layer, and/or other conductive means.

As shown in FIGS. 1A–B, the patch antenna comprising the conductive patch 11 can include two feed ports 21 (corresponding to coaxial feedlines 19) to provide a balanced feed for the patch antenna. While a balanced feed may provide better isolation with respect to the monopole antenna, a single feed port 21 (and corresponding feedline 19) may provide an acceptable level of isolation at a lower cost. In particular, a patch antenna with a single unbalanced feedline 19 may not be constrained to radiate in a pure patch-type mode thereby increasing coupling between the patch and monopole antennas, especially outside the resonance of the patch antenna.

Figure 2A:
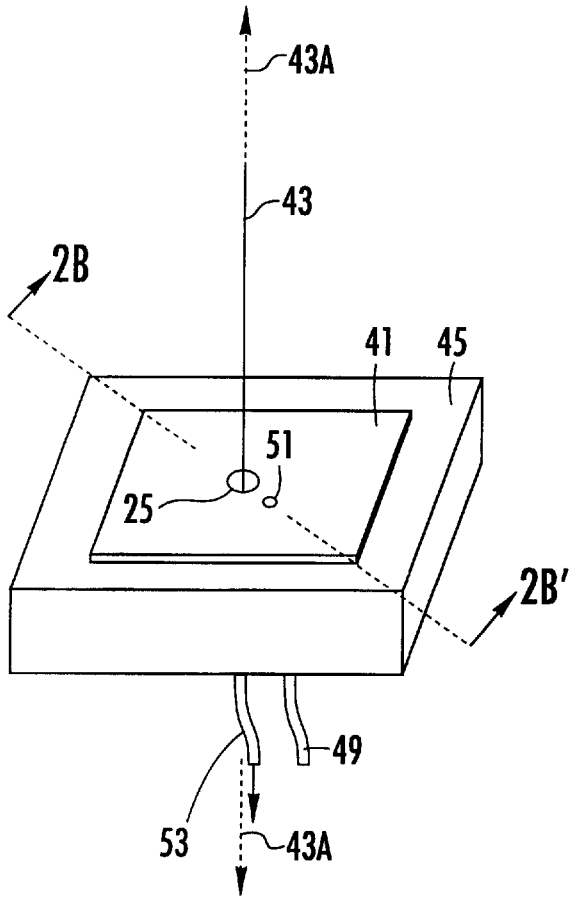
FIG. 2A is a perspective view of antenna structures according to embodiments of the present invention.
Figure 2B:
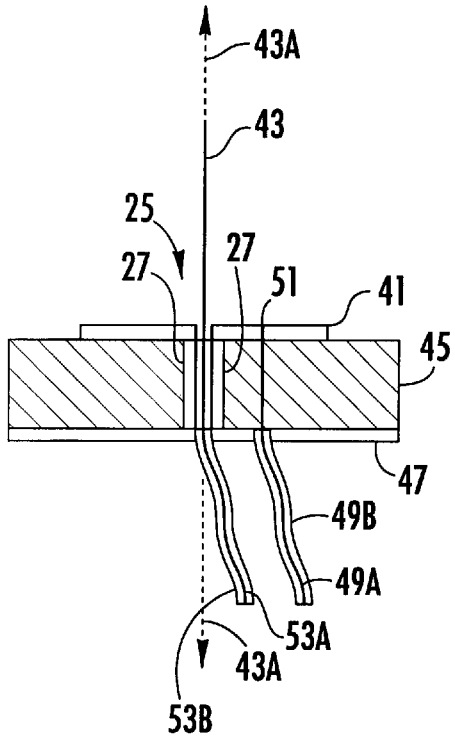
FIG. 2B is a cross sectional view taken along section line 2B–2B' of FIG. 2A.

It has been determined experimentally, that the use of a single unbalanced feed port for the patch antenna can provide an acceptable compromise. In particular, an experimental model including an over-sized patch antenna comprising planar conductive patch 41 and a monopole antenna comprising a single-band wire monopole 43 (which was resonated in the PCS band) were provided as illustrated in FIGS. 2A–B. The wire monopole 43 defines a central axis 43A that is orthogonal and centered with respect to the conductive patch 41. The conductive patch 41 and a conductive ground plane 47 are provided on opposite sides of a dielectric layer 45, and a single feed port 51 is coupled to the feedline 49, and the wire monopole 43 is coupled to coaxial feedline 53. The structure of the antenna assembly illustrated in FIGS. 2A–B is the same as that illustrated in FIGS. 1A–B with the exception that the patch antenna is provided with only a single feed port. In addition, the dimensions of the patch antenna were adjusted to compensate for the addition of the monopole feedline coupling therethrough.

Figure 2C:
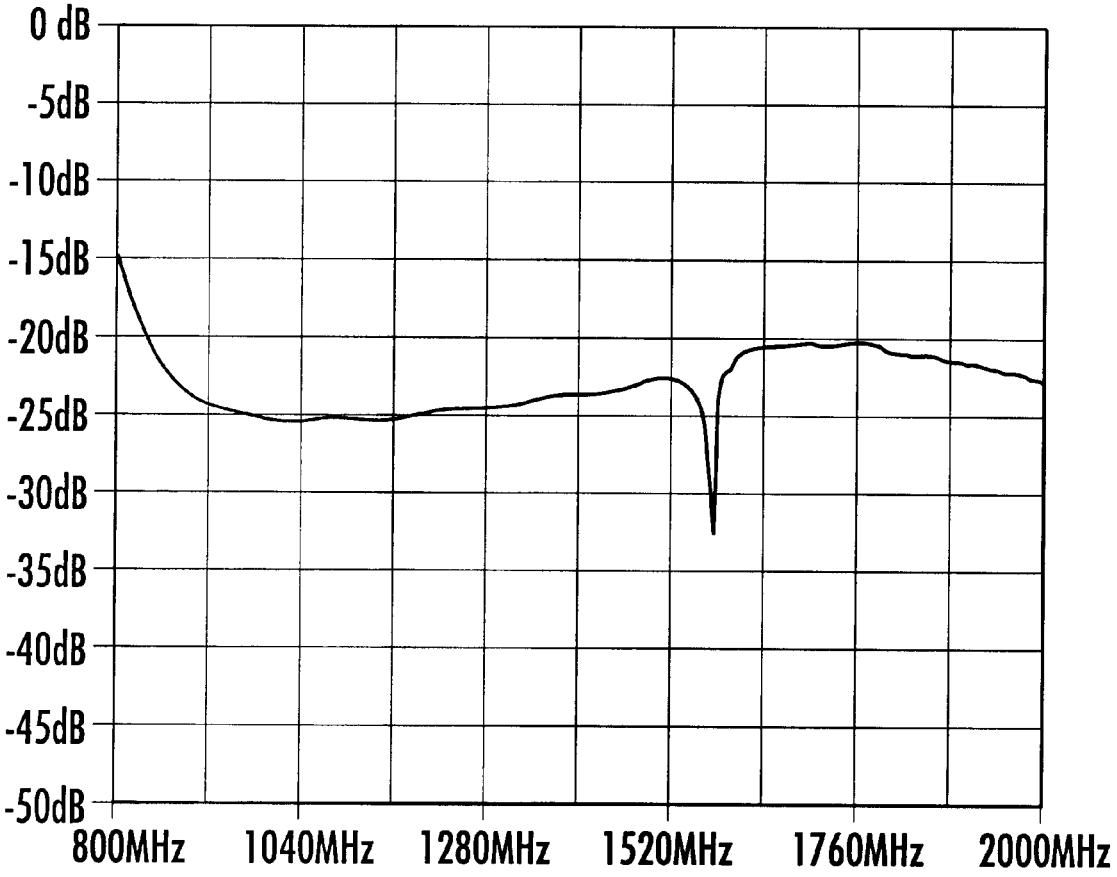
FIG. 2C is a graph illustrating coupling for an antenna structure according to FIGS. 2A and 2B.

A measured coupling for the experimental configuration of FIGS. 2A–B is illustrated in FIG. 2C. Over most of the frequency range tested, the isolation between the two antennas is greater than 20 dB, with even greater isolation provided near the GPS frequency of approximately 1575 MHz. This null in the coupling response demonstrates the effectiveness of the orthogonal mode isolation. While orthogonality may be compromised outside the null, the combination of partial orthogonality and the out-of-band mismatch of the patch antenna provide acceptable isolation.

As shown in FIGS. 1A–B and 2A–B, antenna structures according to embodiments of the present invention can include a first antenna such as a patch antenna including a conductive patch (11 or 41) and a second antenna defining a central axis about which the second antenna is symmetric. While the second antenna can be a wire monopole (13 or 43) as discussed above, the second antenna is preferably any antenna that is symmetrical about its central axis. As discussed in greater detail below with regard to FIGS. 3 and 4, the second antenna can be a dual band monopole (113 or 243) printed on a dielectric substrate. Alternately, the second antenna can be a helix or any other structure symmetric about a central axis. As discussed above, symmetry about a central axis can provide improved isolation between the antennas when the central axis is orthogonal and central with respect to the patch antenna.

Figure 3:
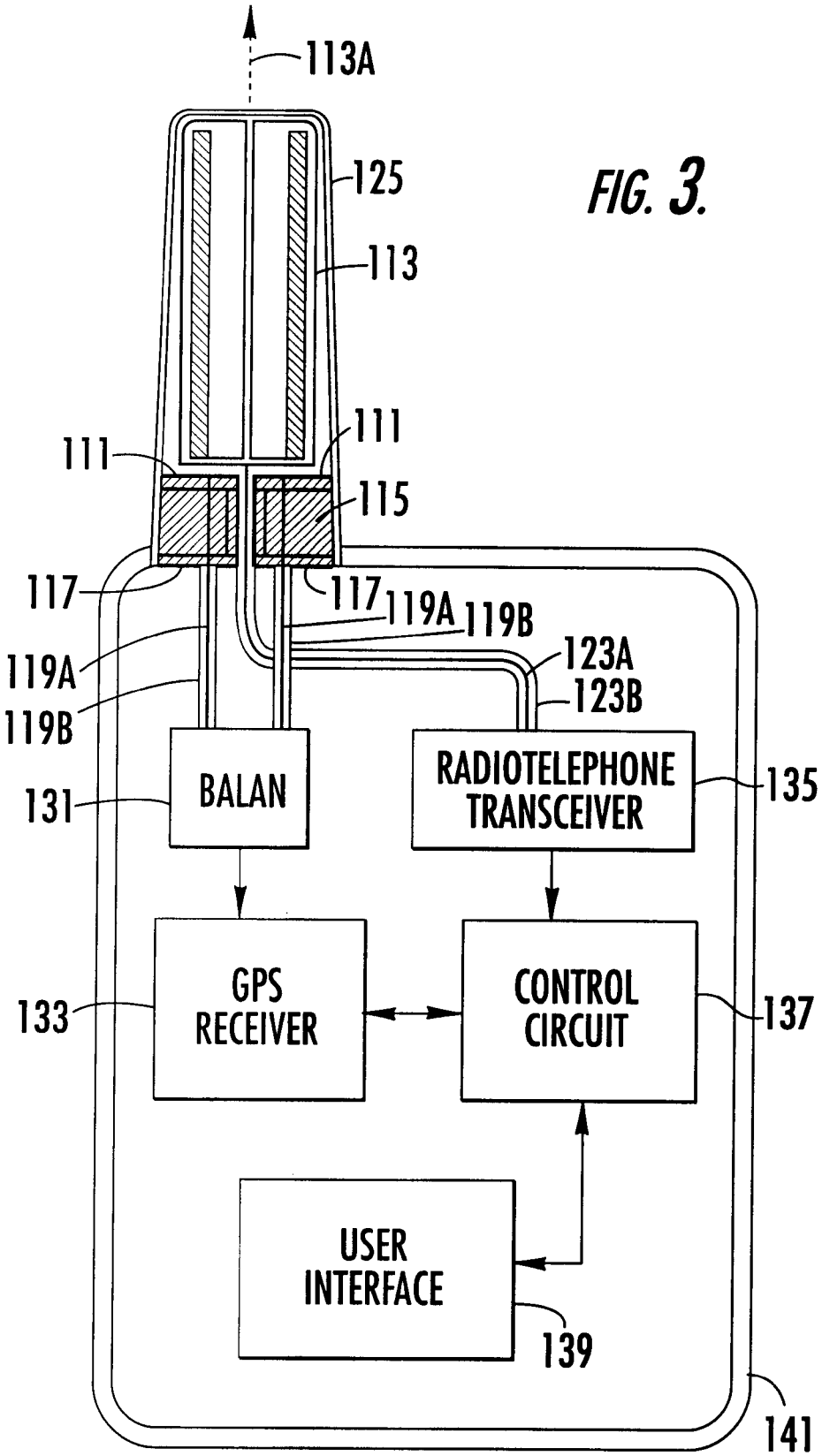
FIG. 3 is a diagram of first mobile terminals including antenna structures according to embodiments of the present invention.
Figure 4:
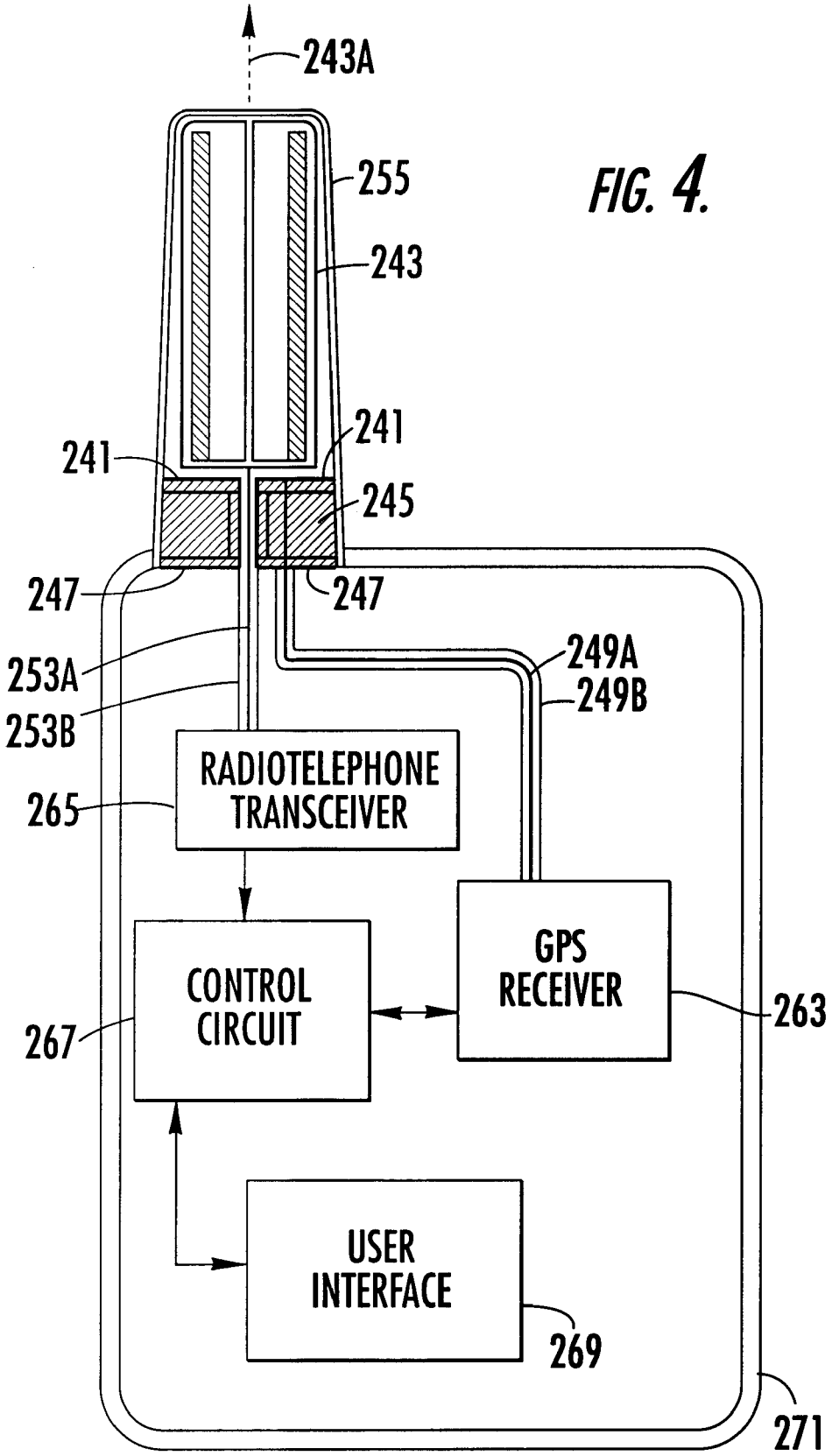
FIG. 4 is a diagram of second mobile terminals including antenna structures according to embodiments of the present invention.

A flat, dual-band monopole antenna (or other symmetrical monopole antenna structure) can thus be combined with a patch antenna as shown in FIGS. 1A–B or FIGS. 2A–B to provide a compact stub antenna. The resulting stub antenna can be used with communications devices such as a radiotelephone including a GPS receiver as shown in FIGS. 3 and 4. FIG. 3 illustrates a radiotelephone including an antenna structure with a patch antenna having two feed ports and a monopole antenna, and FIG. 4 illustrates a radiotelephone including an antenna structure with a patch antenna having one feed port and a monopole antenna. In both radiotelephones, the patch antenna is shown coupled with a GPS receiver, and the monopole antenna is shown coupled with a radiotelephone transceiver.

As shown in FIG. 3, a patch antenna can include a conductive patch 111 on a dielectric layer 115, and a conductive ground plane 117 can be provided on the dielectric layer 115 opposite the conductive patch 111. The patch antenna feedlines including respective inner conductors 119A and outer groundlines 119B provide coupling between the conductive patch 111 and the balun 131. More particularly, the inner conductors 119A are coupled to respective feed ports of the conductive patch 111, and the outer groundlines 119B are coupled to the conductive ground plane 117 as discussed above with regard to FIGS. 1A–B. The balun 131 combines the signals from the two feed ports, and provides the combined signal to the GPS receiver 133 to determine a location of the radiotelephone.

In the example of FIG. 3, a dual band monopole antenna 113 defines and is symmetrical about a central axis 113A. The central axis 113A is orthogonal and centered with respect to the conductive patch 111 so that fields of the monopole antenna 113 cancel with respect to the conductive patch 111 and vice versa thereby providing isolation therebetween as discussed above with regard to FIG. 1. Signals transmitted and received through the monopole antenna 113 are coupled with the radiotelephone receiver 135 through the coaxial feedline including the central feedline 123A and the outer groundline 123B. In particular, the central feedline 123A is coupled with the monopole antenna 113 through a hole in the conductive ground plane 117, the dielectric layer 115, and the conductive patch 111. The outer groundline is coupled with the conductive ground plane 117 and also with the conductive patch 111 through the hole in the center of the dielectric layer 115. The conductive patch 111 is thus shorted to the conductive ground plane 117 at a null point thereof thereby providing coupling of the monopole antenna 113 through the conductive patch 111 without significantly affecting the performance of the patch antenna.

The antenna assembly including the monopole antenna and the patch antenna can be enclosed in a protective radome 125 to provide a compact and esthetically acceptable stub antenna for the radiotelephone including the GPS receiver 133. As discussed above, the use of two feed ports on the conductive patch 111 can provide a balanced feed and thus a higher degree of isolation between the patch and monopole antennas. The balun 131, however, may be needed to combine the signals from the two feedlines 119 into one signal for the GPS receiver 133. The coaxial feedline 123 can couple signals between the monopole antenna and the radiotelephone transceiver 135 to provide radiotelephone communications. Both the GPS receiver 133 and the radiotelephone transceiver 135 can operate under direction of signals to and from the controller 137 with input and output being provided through the user interface 139. The user interface, for example, can include a microphone, a speaker, a keypad, an alpha-numeric display, and/or a graphic display. The balun, transceiver, GPS receiver, control circuit, and user interface can be provided within a mobile housing 141 to provide mobile communications.

The radiotelephone of FIG. 4 is similar to that of FIG. 3 with the exception that the patch antenna including the conductive patch 241 is provided with only a single unbalanced feed port and corresponding feedline 249 including inner conductor 249A and outer groundline 249B. The single feedline 249 can thus be coupled directly with the GPS receiver 263 without a balun therebetween thereby simplifying the structure of FIG. 4. As discussed above with regard to FIGS. 2A–C, an acceptable level of isolation can be provided with a conductive patch 241 including a single unbalanced feed port according to the present invention.

As shown in FIG. 4, a patch antenna can include a conductive patch 241 on a dielectric layer 245 with a conductive ground plane 247 on the dielectric layer 245 opposite the conductive patch 241. A patch antenna feedline 249 includes an inner feedline 249A coupled to a feed port of the conductive patch 241 and an outer groundline 249B coupled to the conductive ground plane 247. The patch antenna feedline thus couples GPS signals from the patch antenna to the GPS receiver 263.

A flat, dual-band monopole antenna 243 defines and is symmetrical about a central axis 243A. The central axis is orthogonal and centered with respect to the conductive patch 241 so that fields of the monopole antenna cancel with respect to the conductive patch 241 providing isolation therebetween as discussed above with regard to FIGS. 2A–C. Signals transmitted and received through the monopole antenna 243 are coupled with the radiotelephone transceiver 265 through the coaxial feedline 253 including a central feedline 253A and an outer groundline 253B. The central feedline 253A is coupled with the monopole antenna through a hole in the conductive patch 241, the dielectric layer 245, and the conductive ground plane 247. The outer groundline 253B is coupled with the conductive ground plane 247 and the conductive patch 241 through the hole in the dielectric layer 245. The conductive ground plane 247 is thus shorted with the conductive patch 241 at a null point of the conductive patch. Coupling of the monopole antenna with the transceiver can thus be efficiently provided through the conductive patch.

The antenna assembly including the conductive patch 241 and the monopole antenna 243 can be enclosed in a protective radome 255 to provide a compact and esthetically acceptable stub antenna for a radiotelephone. The antenna assembly of FIG. 4 can thus provide an acceptable level of isolation between the monopole and patch antennas without a balun. The conductive patch 241 is thus coupled via the feedline 249 with the GPS receiver 263 to provide global positioning information. The monopole antenna 243 is coupled with the radiotelephone transceiver 265 via the feedline 253 to provide radiotelephone communications. Both the GPS receiver 263 and the radiotelephone transceiver 265 can operate under direction of signals to and from the control circuit 267 with input and output being provided through the user interface 269. The user interface, for example, can include a microphone, a speaker, a keypad, an alpha-numeric display, and/or a graphic display. The transceiver, GPS receiver, control circuit, and user interface can be provided within a mobile housing 271 to provide mobile communications.

While antenna assemblies according to the present invention are discussed above in the context of radiotelephones including GPS receivers, aspects of the present invention can be used to provide antenna assemblies for other radio devices including two antennas. For example, antenna assemblies according to the present invention can be used with radio devices such as wireless or mobile communications terminals which can be defined to include cellular radiotelephones with or without a multi-line display; Personal Communications System (PCS) terminals that may combine a cellular radiotelephone with data processing, facsimile and data communications capabilities; personal digital assistants (PDAs) that can include a radiotelephone, pager, Internet/intranet access, Web browser, organizer, calendar and/or a global positioning system (GPS) receiver; and conventional laptop and/or palmtop receivers or other appliances that include a radiotelephone transceiver. Wireless or mobile terminals may also be referred to as "pervasive computing" devices.

According to a first aspect of the present invention, an antenna structure can include a first antenna including a conductive patch and a second antenna adjacent the conductive patch. More particularly, the second antenna can define a central axis wherein the central axis is orthogonal with respect to the first antenna and wherein the central axis intersects a central portion of the conductive patch. Such an arrangement can provide a relatively high degree of isolation between the first and second antennas when provided in close proximity.

More particularly, the second antenna can be symmetrical with respect to the central axis. Fields of the second antenna can thus be orthogonal and symmetric with respect to the conductive patch so that fields of the second antenna cancel with respect to the first antenna and vice versa to provide isolation therebetween.

According to a second aspect of the present invention, an antenna structure can include a first antenna including a conductive patch with an opening through the conductive patch, and a second antenna adjacent the conductive patch wherein a feedline for the second antenna extends through the opening through the conductive patch. By extending the feedline for the second antenna through the opening in the conductive layer of the first antenna, the two antennas can be more easily provided in close proximity. More particularly, the opening through the conductive patch can be centered with respect to the patch. Because the center of a patch antenna is a voltage null point, the opening through the conductive patch can be provided without significantly affecting the performance of the antenna including the conductive patch.

In addition, the first antenna can include a dielectric layer with the conductive patch thereon and with the opening extending through both the conductive patch and the dielectric layer. The feedline can extend through the hole through both the conductive patch and the dielectric layer and an outer groundline of the feedline can be electrically coupled with the conductive patch at the opening therethrough. Because the conductive patch is coupled with the outer groundline at the center of the patch which is a voltage null point, performance of the antenna including the conductive patch is not significantly affected.

In the drawings and specification, there have been disclosed typical preferred embodiments of the invention and, although specific terms are employed, they are used in a generic and descriptive sense only and not for purposes of limitation, the scope of the invention being set forth in the following claims.

What which is claimed is:

1. An antenna structure comprising:

a first antenna including a conductive patch; and a second antenna adjacent the conductive patch wherein the second antenna defines a central axis, wherein the central axis is orthogonal with respect to the first antenna, and wherein the central axis intersects a central portion of the conductive patch;

wherein the conductive patch includes an opening therethrough and wherein the second antenna includes a feedline extending through the opening through the conductive patch;

wherein the first antenna further includes a dielectric layer with the conductive patch thereon and with the opening extending through both the conductive patch and the dielectric layer and with the feedline for the second antenna extending through the opening through both the conductive patch and the dielectric layer; and wherein the feedline for the second antenna comprises a coaxial feedline including a central feedline and an outer groundline wherein the outer groundline is electrically coupled with the conductive patch at the opening therethrough.

2. An antenna structure according to claim 1 wherein the second antenna is symmetrical with respect to the central axis.

3. An antenna structure according to claim 1 wherein the central axis intersects the opening through the conductive patch.

4. An antenna structure according to claim 1 wherein the opening through the conductive patch is located in the central portion of the conductive patch.

5. An antenna structure according to claim 1 wherein the opening through the conductive patch is centered with respect to the patch.

6. An antenna structure according to claim 1 wherein the first antenna further includes a ground plane on the dielectric layer opposite the conductive patch with the opening extending through the conductive patch, the dielectric layer, and the ground plane and with the feedline for the second antenna extending through the ground plane.

7. An antenna structure according to claim 6 wherein the outer groundline is electrically coupled with the conductive patch at the opening therethrough.

8. An antenna structure according to claim 6 wherein the outer groundline is electrically coupled with the ground plane at the opening extending through the conductive patch, the dielectric layer, and the ground plane.

9. An antenna structure according to claim 8 wherein the ground plane is electrically coupled with the conductive patch through the opening extending through the conductive patch, the dielectric layer, and the ground plane.

10. An antenna structure comprising:

a first antenna including a conductive patch with an opening through the conductive patch; and a second antenna adjacent the conductive patch wherein a feedline for the second antenna extends through the opening through the conductive patch;

wherein the first antenna further includes a dielectric layer with the conductive patch thereon and with the opening extending through both the conductive patch and the dielectric layer and with the feedline for the second antenna extending through the opening through both the conductive patch and the dielectric layer; and wherein the feedline for the second antenna comprises a coaxial feedline including a central feedline and an outer groundline wherein the outer groundline is electrically coupled with the conductive patch at the opening therethrough.

11. An antenna structure according to claim 10 wherein the second antenna defines a central axis and wherein the central axis is orthogonal with respect to the conductive patch.

12. An antenna structure according to claim 11 wherein the second antenna is symmetrical with respect to the central axis.

13. An antenna structure according to claim 11 wherein the central axis intersects the opening through the conductive patch.

14. An antenna structure according to claim 11 wherein the central axis intersects a central portion of the conductive patch.

15. An antenna structure according to claim 10 wherein the opening through the conductive patch is centered with respect to the patch.

16. An antenna structure according to claim 10 wherein the first antenna further include a ground plane on the dielectric layer opposite the conductive patch with the opening extending through the conductive patch, the dielectric layer, and the ground plane and with the feedline for the second antenna extending through the ground plane.

17. A An antenna structure according to claim 16 wherein the outer groundline is electrically coupled with the conductive patch at the opening therethrough.

18. An antenna structure according to claim 16 wherein the outer groundline is electrically coupled with the ground plane at the opening extending through the conductive patch, the dielectric layer, and the ground plane.

19. An antenna structure according to claim 18 wherein the ground plane is electrically coupled with the conductive patch through the opening extending through the conductive patch, the dielectric layer, and the ground plane.

20. A radio device comprising:

a first antenna including a conductive patch;

one of a first transmitter or receiver coupled with the conductive patch;

a second antenna adjacent the conductive patch wherein the second antenna defines a central axis, wherein the central axis is orthogonal with respect to the first antenna, and wherein the central axis intersects a central portion of the conductive patch; and one of a second transmitter or receiver coupled with the second antenna;

wherein the conductive patch includes an opening therethrough and wherein the second antenna includes a feedline extending through the opening through the conductive patch wherein the second antenna is coupled with the second transmitter or receiver via the feedline;

wherein the first antenna further includes a dielectric layer with the conductive patch thereon and with the opening extending through both the conductive patch and the dielectric layer and with the feedline for the second antenna extending through the opening through both the conductive patch and the dielectric layer; and wherein the feedline for the second antenna comprises a coaxial feedline including a central feedline and an outer groundline wherein the outer groundline is electrically coupled with the conductive patch at the opening therethrough.

21. A radio device according to claim 20 wherein the second antenna is symmetrical with respect to the central axis.

22. A radio device according to claim 20 wherein the central axis intersects the opening through the conductive patch.

23. A radio device according to claim 20 wherein the opening through the conductive patch is located in the central portion of the conductive patch.

24. A radio device according to claim 20 wherein the opening through the conductive patch is centered with respect to the patch.

25. A radio device according to claim 20 wherein the first antenna further includes a ground plane on the dielectric layer opposite the conductive patch with the opening extending through the conductive patch, the dielectric layer, and the ground plane and with the feedline for the second antenna extending through the ground plane.

26. A radio device according to claim 25 wherein the outer groundline is electrically coupled with the conductive patch at the opening therethrough.

27. A radio device according to claim 25 wherein the outer groundline is electrically coupled with the ground plane at the opening extending through the conductive patch, the dielectric layer, and the ground plane.

28. A radio device according to claim 27 wherein the ground plane is electrically coupled with the conductive patch through the opening extending through the conductive patch, the dielectric layer, and the ground plane.

29. A radio device comprising:

a first antenna including a conductive patch with an opening through the conductive patch;

one of a first transmitter or receiver coupled with the first antenna;

a second antenna adjacent the conductive patch wherein a feedline for the second antenna extends through the opening through the conductive patch; and one of a second transmitter or receiver coupled with the second antenna through the feedline for the second antenna;

wherein the first antenna further includes a dielectric layer with the conductive patch thereon and with the opening extending through both the conductive patch and the dielectric layer and with the feedline for the second antenna extending through the opening through both the conductive patch and the dielectric layer; and wherein the feedline for the second antenna comprises a coaxial feedline including a central feedline and an outer groundline wherein the outer groundline is electrically coupled with the conductive patch at the opening therethrough.

30. A radio device according to claim 29 wherein the second antenna defines a central axis and wherein the central axis is orthogonal with respect to the conductive patch.

31. A radio device according to claim 30 wherein the second antenna is symmetrical with respect to the central axis.

32. A radio device according to claim 30 wherein the central axis intersects the opening through the conductive patch.

33. A radio device according to claim 30 wherein the central axis intersects a central portion of the conductive patch.

34. A radio device according to claim 29 wherein the opening through the conductive patch is centered with respect to the patch.

35. A radio device according to claim 29 wherein the first antenna further include a ground plane on the dielectric layer opposite the conductive patch with the opening extending through the conductive patch, the dielectric layer, and the ground plane and with the feedline for the second antenna extending through the ground plane.

36. A radio device according to claim 35 wherein the outer groundline is electrically coupled with the conductive patch at the opening therethrough.

37. A radio device according to claim 35 wherein the outer groundline is electrically coupled with the groung plane at the opening extending through the conductive patch, the dielectric layer, and the ground plane.

38. A radio device according to claim 37 wherein the ground plane is electrically coupled with the conductive patch through the opening extending through the conductive patch, the dielectric layer, and the ground plane.

* * * * *